US010407205B2

(12) United States Patent
Chou

(10) Patent No.: US 10,407,205 B2
(45) Date of Patent: Sep. 10, 2019

(54) FOLDING BOX

(71) Applicant: Chi-Ming Chou, Taipei (TW)

(72) Inventor: Chi-Ming Chou, Taipei (TW)

( * ) Notice: Subject to any disclaimer, the term of this patent is extended or adjusted under 35 U.S.C. 154(b) by 0 days.

(21) Appl. No.: 15/683,840

(22) Filed: Aug. 23, 2017

(65) Prior Publication Data

US 2018/0354675 A1 Dec. 13, 2018

(30) Foreign Application Priority Data

Jun. 9, 2017 (TW) ..... 106208392 U

(51) Int. Cl.

| | |
|---|---|
| ***B65D 5/42*** | (2006.01) |
| ***B65D 5/20*** | (2006.01) |
| ***B65D 5/36*** | (2006.01) |
| ***B65D 5/44*** | (2006.01) |
| ***B65D 5/60*** | (2006.01) |
| ***B42F 7/06*** | (2006.01) |
| ***B42F 7/14*** | (2006.01) |
| *B65D 5/22* | (2006.01) |

(52) U.S. Cl.

CPC ..... *B65D 5/4212* (2013.01); *B42F 7/06* (2013.01); *B42F 7/14* (2013.01); *B65D 5/20* (2013.01); *B65D 5/3664* (2013.01); *B65D 5/445* (2013.01); *B65D 5/60* (2013.01); *B65D 5/22* (2013.01)

(58) Field of Classification Search

CPC ..... B65D 5/422; B65D 5/4225; B65D 5/22; B42F 7/06; B42F 7/14

See application file for complete search history.

(56) References Cited

U.S. PATENT DOCUMENTS

| | | | | | |
|---|---|---|---|---|---|
| 748,376 | A * | 12/1903 | Hirsch | B65D 5/22 | 229/178 |
| 2,751,138 | A * | 6/1956 | Laver | B65D 5/2033 | 229/109 |
| 2,866,587 | A * | 12/1958 | Struble | B65D 5/2009 | 229/167 |
| 2,950,852 | A * | 8/1960 | Hutchison | B65D 5/22 | 229/120.32 |
| 6,145,175 | A * | 11/2000 | Enneking | B65D 5/22 | 27/19 |
| 9,021,668 | B2 * | 5/2015 | Hui | A61G 17/0073 | 27/14 |
| 2009/0095800 | A1 * | 4/2009 | Tao | B65D 5/22 | 229/117.03 |
| 2010/0006632 | A1 * | 1/2010 | Conroy | B65D 5/248 | 229/120.18 |
| 2012/0153013 | A1 * | 6/2012 | Covelli | B65D 5/0015 | 229/100 |
| 2013/0219761 | A1 * | 8/2013 | Edmondson | A47G 1/06 | 40/743 |
| 2014/0217159 | A1 * | 8/2014 | Schewe | B65D 5/24 | 229/117.18 |

(Continued)

*Primary Examiner* — Derek J Battisti

(57) ABSTRACT

A folding box has a foldable positioning piece extending from an outer edge of each of front and rear panels thereof. A first reinforcement sheet is attached and connected to the positioning piece, thereby reinforcing the strength of the front and rear panels and side panels of the folding box. By the extension of the reinforcement sheets, the structural stability of the folding box can be maintained when the folding box is produced with the thin cardboard and the area required for the preparation of the cardboard is reduced.

2 Claims, 9 Drawing Sheets

(56) References Cited

U.S. PATENT DOCUMENTS

2016/0122073 A1* 5/2016 Aguirre ..... B65D 5/443
206/509
2016/0362218 A1* 12/2016 Bourdin ..... B65D 5/22

* cited by examiner

FOLDING BOX

FIELD OF THE INVENTION

The present invention relates to a folding box, and more particularly to a folding box having a plurality of reinforcement sheets to reinforce the strength of front and rear panels and side panels of the folding box. The structural stability of the folding box can be maintained when the folding box is produced with thin cardboard under environmental considerations and the area required for the preparation of the cardboard is reduced.

BACKGROUND OF THE INVENTION

In addition to the functions for protecting products and facilitating the transportation and storage of products, the quality of the products may be set off by a box made of cardboard, such as a hardcover stationary box. Most boxes are made of cardboard having a certain thickness. The overall appearance is exquisite and pleasing to the eyes and the structure is stable.

FIG. 1 illustrates a conventional folding box. A piece of thick cardboard is preset with a plurality of fold lines. The cardboard is folded to be a flat half-folded box 100 to facilitate transportation and storage. When in use, as shown in FIG. 2, the half-folded box 100 is unfolded and fixed with the viscose 101 to form a three-dimensional shape, that is, the assembly of the folding box is completed.

The folding box has the same quality as a stationary box, and has the advantage of saving transportation and storage space. However, the folding box still uses cardboard having a certain thickness, so the material cost is high. Although the box is fixed by means of viscose, the cardboard may rebound after folded, resulting in a collapse of the folding box.

The inventor of this application develops a polygonal folding box with thin cardboard to save materials and reduce production costs and take into account environmental protection. This folding box is easily distorted and deformed to affect the overall structural strength of the folding box. Accordingly, the inventor of the present invention has devoted himself based on his many years of practical experiences to solve these problems.

SUMMARY OF THE INVENTION

The primary object of the present invention is to provide a folding box. The folding box may be produced with thin cardboard, and the area required for the preparation of the cardboard is reduced. Each of front and rear panels and a plurality of side panels of the folding box is provided with a reinforcement sheet, so that the folding box is able to save the material cost and is environment-friendly and has a stable structure.

In order to achieve the aforesaid object, the folding box of the present invention is formed by folding a piece of cardboard having preset indented fold lines and comprises a polygonal bottom panel. A front panel and a rear panel extend from a front edge and a rear edge of the polygonal bottom panel, respectively. The polygonal bottom panel has at least two side edges. At least one side panel extends from each of the side edges. A foldable positioning piece extends from an outer edge of each of the front and rear panels. A first reinforcement sheet is attached and fixed to the positioning piece. Auxiliary retaining pieces are each disposed at a position adjacent to the side panel and each of the front and rear panels and adhered to inner side surfaces of the front and rear panels respectively. A foldable piece extends from an outer edge of the side panel. The foldable piece is folded and adhered to an inner side surface of the side panel. A second reinforcement sheet is provided between the inner side surfaces of the foldable piece and the side panel. The front and rear panels and the side panels at the two side edges of the polygonal bottom panel are respectively erected on the polygonal bottom panel to jointly define an accommodation space therein. The positioning pieces and the first reinforcement sheets of the front and rear panels are folded inwardly to overlap inner side surfaces of the corresponding auxiliary retaining pieces to retain a three-dimensional shape of the folding box.

Preferably, the first reinforcement sheet is preset and fixed to the positioning piece. The second reinforcement sheet is preset and fixed to the side panel or the foldable piece. The second reinforcement sheet and the foldable piece are folded and adhered to the inner side surface of the side panel, and the auxiliary retaining pieces are adhered to the inner side surfaces of the front and rear panels respectively so that the folding box is in a flat half-folded state.

Preferably, each of the auxiliary retaining pieces is provided with a diagonal indented fold line. The diagonal indented fold line extends from a lower edge of each of the front and rear panels to a center of an upper edge of each of the front and rear panels. The side panel is folded and erected upward to bring the front and rear panels to be simultaneously erected through the respective auxiliary retaining pieces. Each of the auxiliary retaining pieces is diagonally folded along the diagonal indented fold line.

With the aforesaid structure, when the side panels are respectively erected on the polygonal bottom panel, the front and rear panels are interlinked to be erected by the respective auxiliary retaining pieces because the auxiliary retaining pieces are adhered to the inner side surfaces of the front and rear panels. The positioning pieces and the first reinforcement sheets of the front and rear panels are folded inwardly to overlap the inner side surfaces of the corresponding auxiliary retaining pieces, so that the three-dimensional shape of the folding box is retained.

The structural design that the positioning pieces and the first reinforcement sheets of the front and rear panels are folded inwardly to overlap the inner side surfaces of the corresponding auxiliary retaining pieces is able to reinforce the strength of the front and rear panels and the side panels of the folding box made of the thin cardboard. When the side panels of the folding box are pressed, it is possible to prevent a collapse through two sides of the first reinforcement sheet to hold against the side panels. The present invention has the advantages of reducing the material cost, environmental protection and structural stability.

Preferably, a plurality of connected side panels are provided at the same side edge of the polygonal bottom panel. A bottom edge of the side panel adjacent to each of the front and rear panels is provided with a connecting piece extending to a brim of the polygonal bottom panel.

Preferably, an edge of the foldable piece of the side panel adjacent to each of the front and rear panels is provided with a flap that can be fixed to the inner side surface of the corresponding auxiliary retaining piece.

Preferably, the polygonal bottom panel has a plurality of side edges arranged in pairs so that the polygonal bottom panel is formed with even-numbered edges.

Compared to the prior art, the folding box made of the thin cardboard of the present invention is provided with the reinforcement sheets on the front and rear panels and the side panels of the folding box to reinforce the strength of the folding box. The present invention has the advantages of reducing the material cost and structural stability.

DETAILED DESCRIPTION OF THE PREFERRED EMBODIMENTS

Embodiments of the present invention will now be described, by way of example only, with reference to the accompanying drawings.

Figure 10:
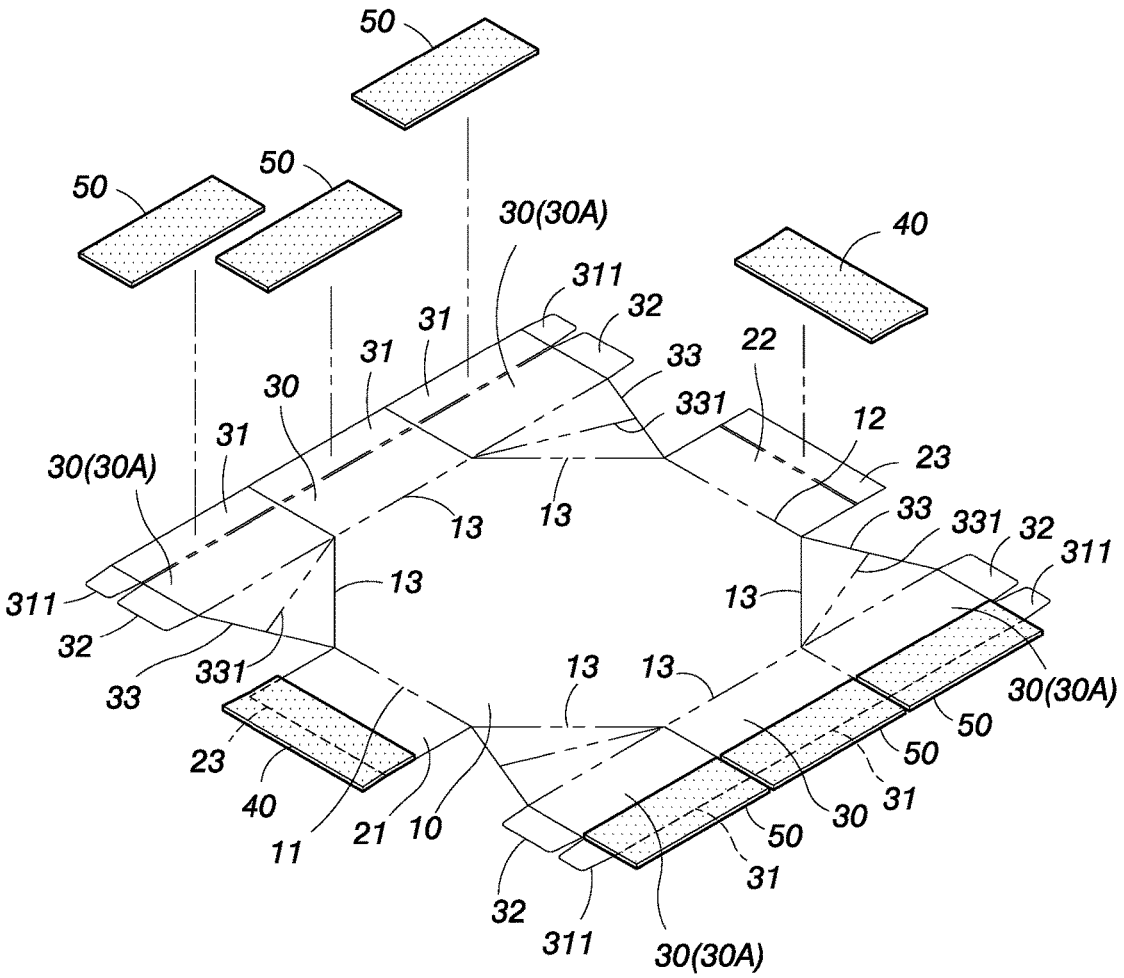
FIG. 10 is an exploded view of the folding box in accordance with a fourth embodiment of the present invention.
Figure 11:
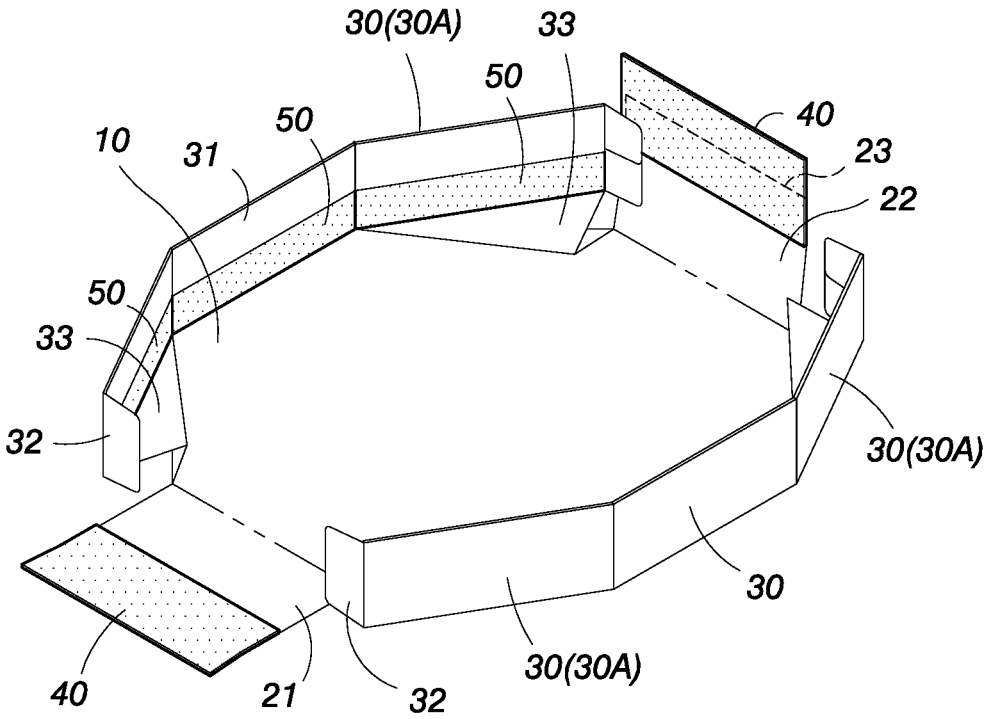
FIG. 11 is a schematic view of the folding box in a folded state in accordance with the fourth embodiment of the present invention.
Figure 12:
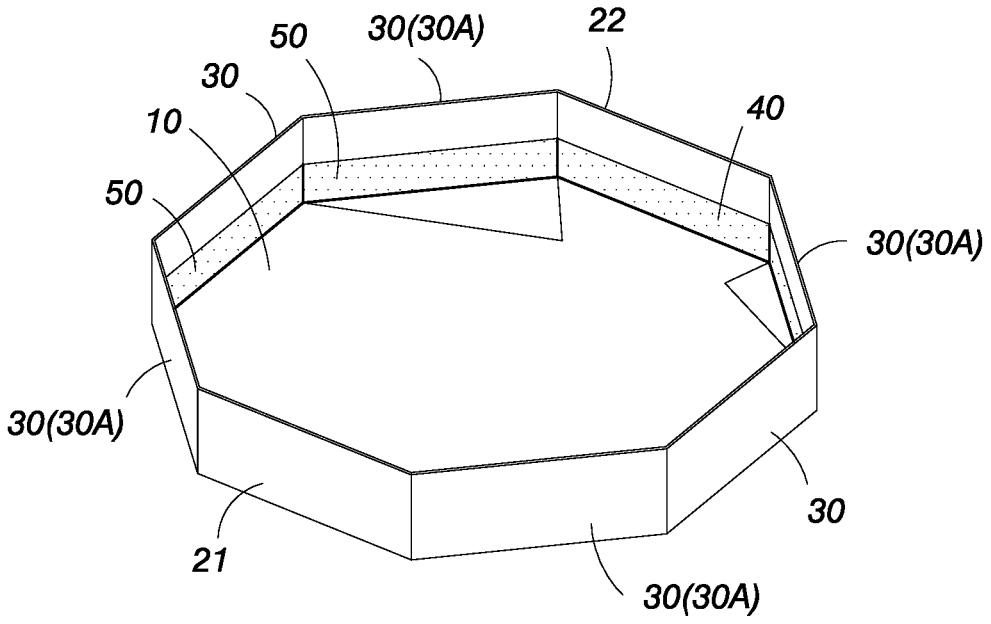
FIG. 12 is a schematic view of the folding box after folded in accordance with the fourth embodiment of the present invention.

The present invention discloses a folding box. The folding box uses reinforcement sheets to reinforce the strength of front and rear panels and side panels of the folding box. By the extension of the reinforcement sheets, the structural stability of the folding box can be maintained when the folding box is produced with thin cardboard and the area required for the preparation of the cardboard is reduced. The folding box is formed by folding the cardboard having preset indented fold lines, and comprises a polygonal bottom panel 10. Referring to FIG. 3 to FIG. 9, a quadrilateral bottom panel is illustrated as an example. Referring to FIG. 10 to FIG. 12, an octagonal bottom panel is illustrated as an example.

As shown in FIG. 3 to FIG. 7, a front panel 21 and a rear panel 22 extend from a front edge 11 and a rear edge 12 of the polygonal bottom panel 10, respectively. The polygonal bottom panel 10 has two side edges 13. At least one side panel 30 extends from each of the side edges 13. A foldable positioning piece 23 extends from an outer edge of each of the front and rear panels 21, 22. A first reinforcement sheet 40 is attached and connected to the positioning piece 23.

Figure 4:
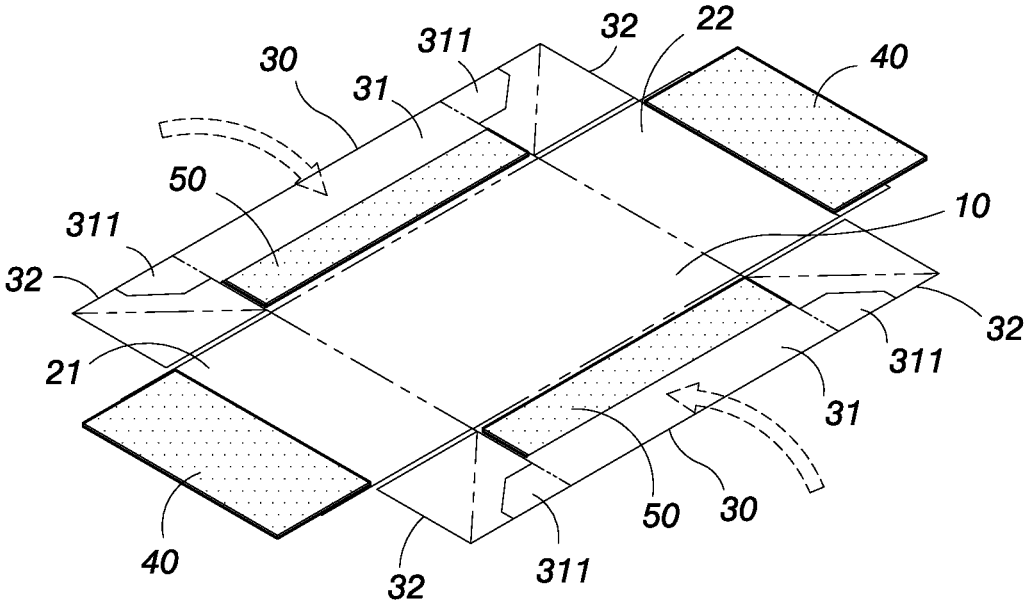
FIG. 4 is a schematic view of the folding box in accordance with the first embodiment of the present invention, showing that the foldable pieces are folded and adhered to the inner side surfaces of the side panels.

A foldable piece 31 extends from an outer edge of each of the two side panels 30. A second reinforcement sheet 50 is attached and connected to the foldable piece 31. As shown in FIG. 4, the foldable piece 31 and the second reinforcement sheet 50 may be folded and adhered to the inner side surface of the side panel 30. Preferably, a flap 311 extends from an edge of the foldable piece 31.

Figure 5:
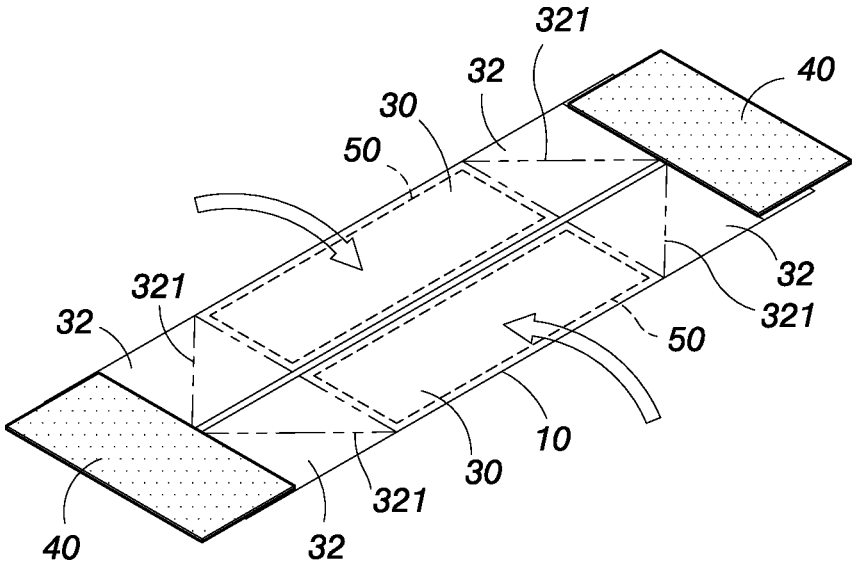
FIG. 5 is a schematic view of the folding box in accordance with the first embodiment of the present invention, showing that the side panels and the second reinforcement sheets are folded and stacked on the polygonal bottom panel.

The folding box further includes auxiliary retaining pieces 32 located at a position adjacent to the two side panels 30 and the front and rear panels 21, 22, respectively. The flap 311 may be retained at an inner side surface of the corresponding auxiliary retaining piece 32. As shown in FIG. 5, when the two side panels 30 and the two second reinforcement sheets 50 are respectively folded on top of the polygonal bottom panel 10, the auxiliary retaining pieces 32 are adhered to the inner side surfaces of the front and rear panels 21, 22, respectively, so that the folding box is in a flat half-folded state to save transportation and storage space.

Figure 6:
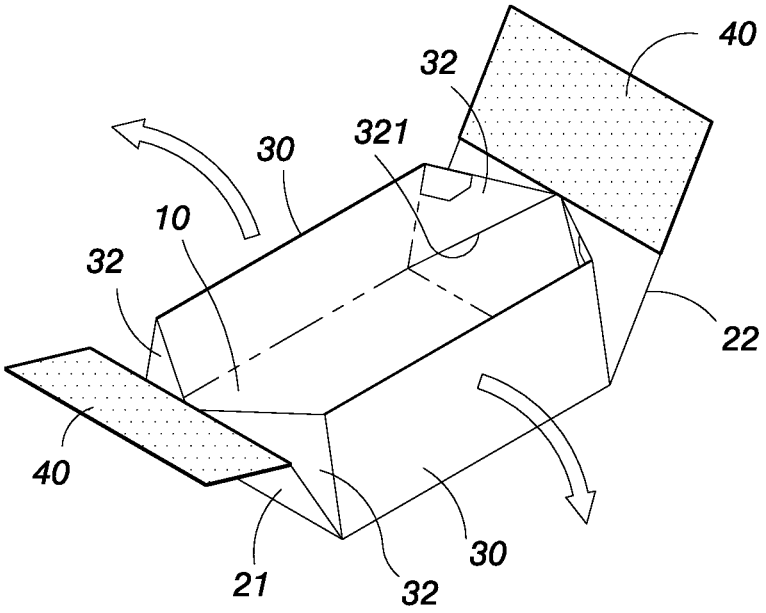
FIG. 6 is a schematic view of the folding box in accordance with the first embodiment of the present invention, showing that the front and rear panels and the side panels are respectively erected on the polygonal bottom panel.

In this embodiment, each of the auxiliary retaining pieces 32 is provided with a diagonal indented fold line 321. The diagonal indented fold line 321 extends from a lower edge of each of the front and rear panels 21, 22 to the center of an upper edge of each of the front and rear panels 21, 22. The front and rear panels 21 and 22 are simultaneously erected by the respective auxiliary retaining pieces 32, as shown in FIG. 6, when the user folds the two side panels 30 upward. Each of the auxiliary retaining pieces 32 is diagonally folded along the diagonal indented fold line 321.

Figure 7:
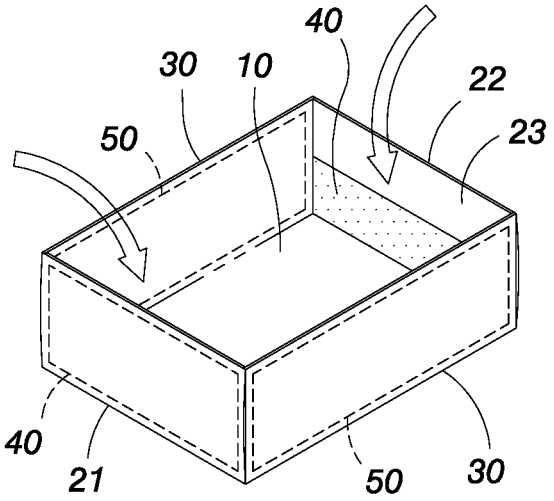
FIG. 7 is a perspective view of the folding box in accordance with the first embodiment of the present invention.

The front and rear panels 21, 22 and the two side panels 30 are respectively erected on the polygonal bottom panel 10 to jointly define an accommodation space therein. The positioning pieces 23 and the first reinforcement sheets 40 of the front and rear panels 21, 22 are folded inwardly to overlap the inner side surfaces of the corresponding auxiliary retaining pieces 32, so that the three-dimensional shape of the folding box is retained as shown in FIG. 7 to complete the assembly of the folding box.

The structural design that the positioning pieces and the first reinforcement sheets of the front and rear panels are folded inwardly to overlap the inner side surfaces of the corresponding auxiliary retaining pieces is able to reinforce the strength of the front and rear panels and the side panels when the folding box is made of the thin cardboard under environmental considerations. When the side panels of the folding box are pressed, it is possible to prevent a collapse through two sides of the first reinforcement sheets to hold against the side panels. The present invention has the advantages of reducing the material cost, environmental protection and structural stability.

Figure 8:
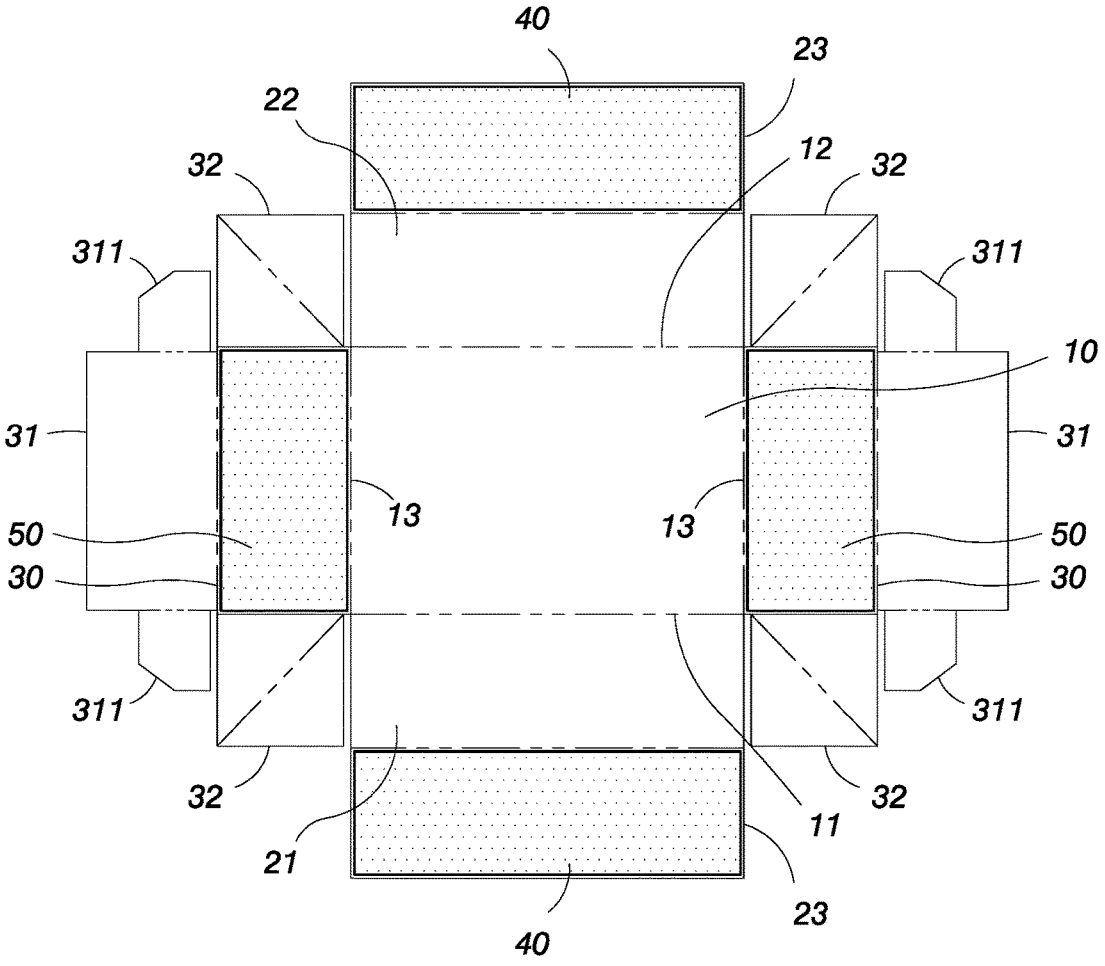
FIG. 8 is a schematic view of the folding box in an unfolded state in accordance with a second embodiment of the present invention.

FIG. 8 illustrates a second embodiment of the folding box. The difference between the first embodiment and the second embodiment is the preset position of the second reinforcement sheet 50. In the first embodiment, the second reinforcement sheet 50 is disposed on the foldable piece 31. In the second embodiment, the second reinforcement sheet 50 is disposed on the side panel 30.

Figure 1:
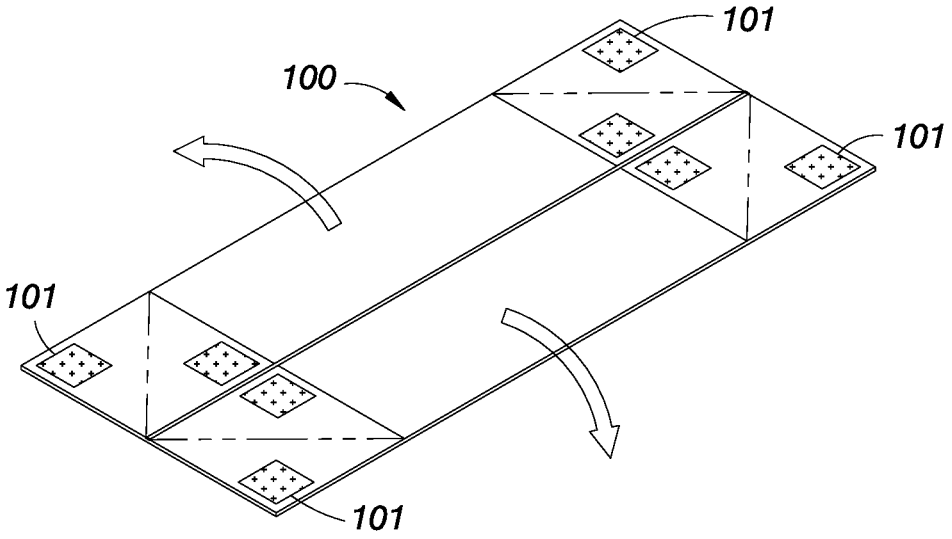
FIG.1 PRIOR ART
FIG. 1 is a schematic view of a conventional folding box in a flat half-folded state.
Figure 2:
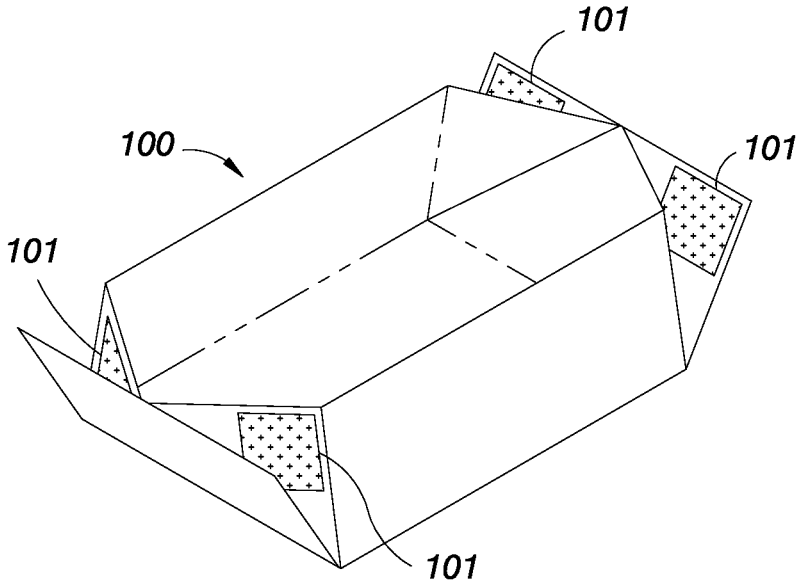
FIG.2 PRIOR ART
FIG. 2 is a schematic view of the conventional folding box in an unfolded state.
Figure 3:
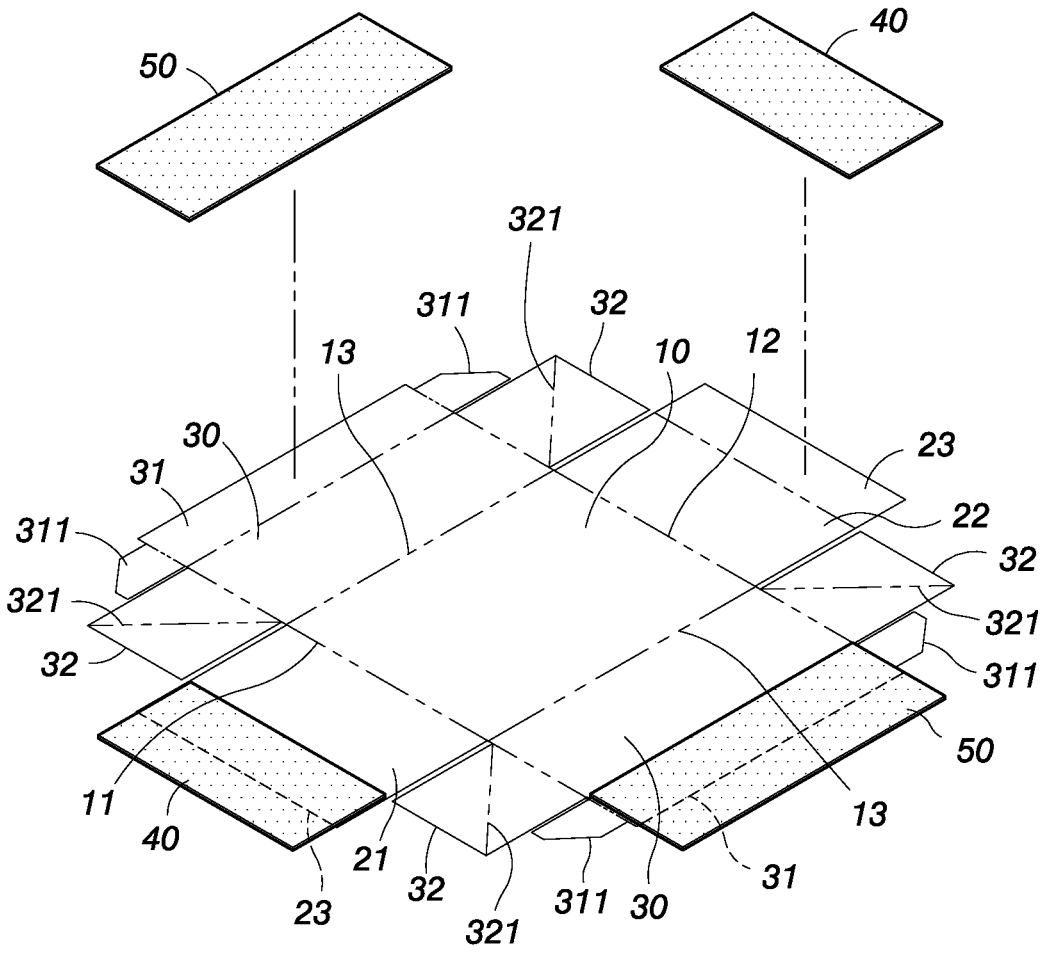
FIG. 3 is an exploded view of the folding box in accordance with a first embodiment of the present invention.

Furthermore, as shown in FIG. 3, the area of each positioning piece 23 may be less than the area of each of the front and rear panels 21, 22. The positioning piece 23 is connected with the first reinforcement sheet 40 to extend outwardly and to have an area about equal to the area of each of the front and rear panels 21, 22. Such a structure may be applied to the foldable piece 31 and the side panel 30, and the area required for the preparation of the cardboard may be reduced. Thus, the folding box of the first embodiment may be made with the thin cardboard, and the area required for the preparation of the cardboard may be reduced to save the material cost.

Figure 9:
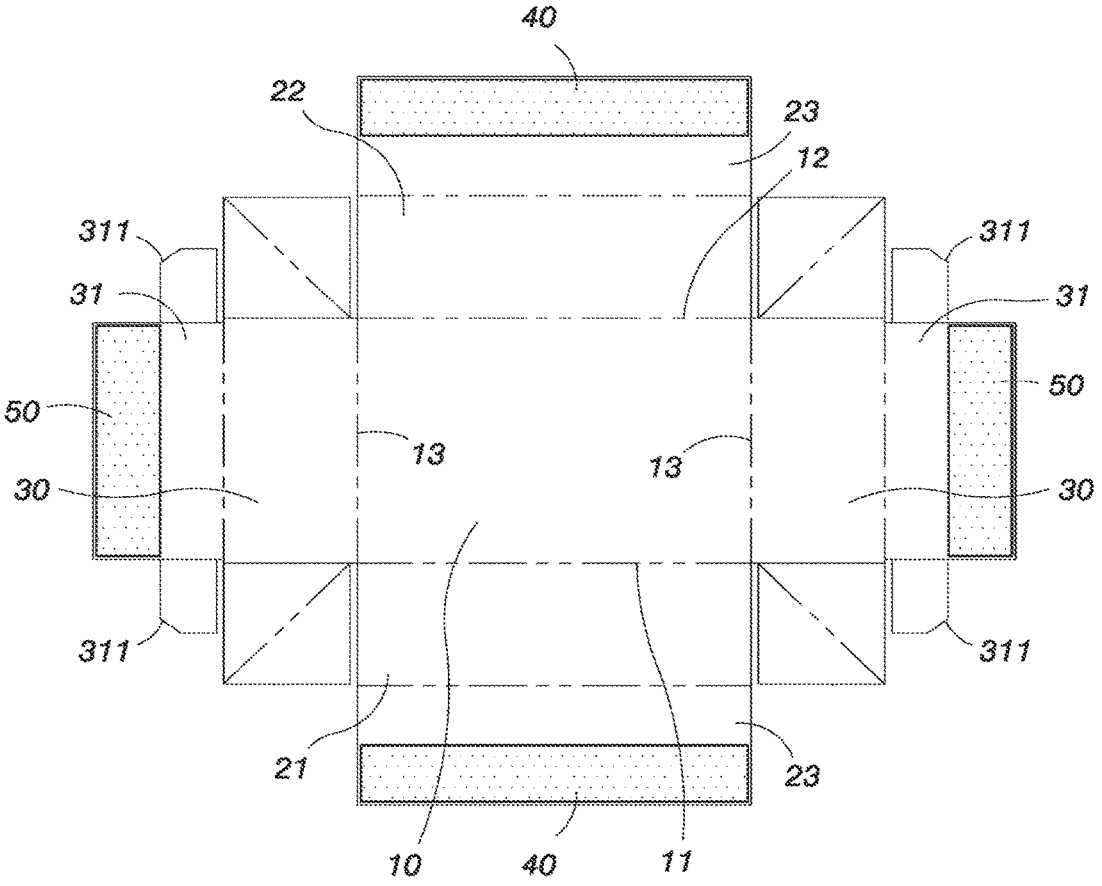
FIG. 9 is a schematic view of the folding box in an unfolded state in accordance with a third embodiment of the present invention.

FIG. 9 illustrates a third embodiment of the folding box. The difference between the second embodiment and the third embodiment is that the area of the first reinforcement sheet 40 is less than the area of each of the front and rear panels 21, 22 or the area of the positioning piece 23; and that the area of the second reinforcement sheet 50 is less than the area of each of the side panels 23 or the area of the foldable piece 31. Similarly, the folding box can be assembled firm, and the area required for the preparation of the reinforcement sheet may be reduced. The folding box of the present invention saves the material cost and is an environment-friendly product.

Referring to FIG. 10 to FIG. 12, an octagonal bottom panel 10 is illustrated. The arrangement and structure of the front and rear panels 21, 22, the side panels 30, the positioning pieces 23, the foldable pieces 31, the first reinforcement pieces 40, and the second reinforcement pieces 50 are substantially similar to the aforesaid embodiments. The following only shows the difference:

As shown in the drawings, a plurality of connected side panels 30 are provided at the same side edge 13 of the polygonal bottom panel 10. The bottom edge of the side panel 30A adjacent to each of the front and rear panels 21, 22 is provided with a connecting piece 33 extending to the brim of the polygonal bottom panel 10. The connecting piece 33 is provided with an indented fold line 331 and can be folded up along the indented fold line 331, such that each side panel 30 can be erected upwardly on the polygonal bottom panel 10.

After the front and rear panels 21, 22 and the plurality of side panels 30 are respectively erected on the polygonal bottom panel 10, the auxiliary retaining pieces 32 are adhered to the inner side surfaces of the front and rear panels 21, 22. After that, the positioning pieces 23 and the first reinforcement sheets 40 of the front and rear panels 21, 22 are folded inwardly to overlap the inner side surfaces of the corresponding auxiliary retaining pieces 32, so that the three-dimensional shape of the folding box is retained to complete the assembly of the octagonal folding box.

The present invention is suitable for a folding box having a polygonal bottom panel 10 with even-numbered edges, but does not exclude a folding box having a polygonal bottom panel 10 with odd-numbered edges.

Although particular embodiments of the present invention have been described in detail for purposes of illustration, various modifications and enhancements may be made without departing from the spirit and scope of the present invention. Accordingly, the present invention is not to be limited except as by the appended claims.

LIST OF REFERENCE NUMBERS

10 polygonal bottom panel
11 front edge
12 rear edge
13 side edge
21 front panel
22 rear panel
23 positioning piece
30, 30A side panel
31 foldable piece
311 flap
32 auxiliary retaining piece
321 diagonal indented fold line
33 connecting piece
331 indented fold line
40 first reinforcement piece
50 second reinforcement piece

What is claimed is:

1. A folding box, formed by folding a piece of cardboard having preset indented fold lines and comprising a polygonal bottom panel, a front panel and a rear panel extending from a front edge and a rear edge of the polygonal bottom panel respectively, the polygonal bottom panel having at least two side edges, at least one side panel extending from each of the side edges, the folding box further comprising:

a foldable positioning piece extending from an outer edge of each of the front and rear panels, a first reinforcement sheet being attached and fixed to each positioning piece;

auxiliary retaining pieces each disposed at a position adjacent to one of the side panels and each of the front and rear panels and adhered to inner side surfaces of the front and rear panels respectively, a foldable piece extending from an outer edge of each side panel, each foldable piece being folded and adhered to an inner side surface of the respective side panel, a second reinforcement sheet being provided between the inner side surfaces of each foldable piece and the respective side panel;

the front and rear panels and the side panels at the two side edges of the polygonal bottom panel being respectively erectable on the polygonal bottom panel to jointly define an accommodation space therein, the positioning pieces and the first reinforcement sheets of the front and rear panels being foldable inwardly to overlap inner side surfaces of the corresponding auxiliary retaining pieces to retain a three-dimensional shape of the folding box;

wherein each first reinforcement sheet is preset and fixed to the respective positioning piece, each second reinforcement sheet is preset and fixed to the side panel or the foldable piece, each second reinforcement sheet and the respective foldable piece are folded and adhered to the inner side surface of the respective side panel, the auxiliary retaining pieces are adhered to the inner side surfaces of the front and rear panels respectively, and the side panels and the second reinforcing sheets are foldable over the polygonal bottom plate so that the folding box is in a flat half-folded state;

each of the auxiliary retaining pieces is provided with a diagonal indented fold line, the diagonal indented fold line extending from a lower edge of each of the front and rear panels to a center of an upper edge of each of the respective front and rear panels to divide the auxiliary retaining piece into a first portion on one side of the diagonal indented fold line and second portion on an opposite side of the diagonal indented fold line, and only the first portion is adhered to the inner side surface of the respective front or rear panel;

an edge of the foldable piece of the side panel adjacent to each of the front and rear panels is provided with a flap that is sized to abut the inner side surface of the second portion of the corresponding auxiliary retaining piece when the foldable piece is folded and adhered to the inner side surface of the respective side panel; and when the two side panels are foldable upward to erect the folding box, the front and rear panels are erected by the respectively auxiliary fixing pieces.

2. The folding box as claimed in claim 1, wherein each side panel is foldable and erectable upward to cause the front and rear panels to be simultaneously erected through the respective auxiliary retaining pieces, and each of the auxiliary retaining pieces is diagonally foldable along the diagonal indented fold line.

* * * * *